United States Patent [19]

Bricmont

[11] Patent Number: 4,863,146

[45] Date of Patent: Sep. 5, 1989

[54] FURNACE ENCLOSURE OR THE LIKE

[76] Inventor: Francis H. Bricmont, 903 Bridgewater Dr., Pittsburgh, Pa. 15206

[21] Appl. No.: 151,026

[22] Filed: Feb. 1, 1988

[51] Int. Cl.[4] ..... C21D 1/34

[52] U.S. Cl. ..... 266/252; 266/280; 432/250

[58] Field of Search ..... 266/280, 286, 108, 196, 266/249, 252; 52/506; 432/250

[56] References Cited

U.S. PATENT DOCUMENTS 3,833,208 9/1974 Andersen ..... 266/108

4,300,753 11/1981 LaBate ..... 266/196

4,429,504 2/1984 Hounsel et al. ..... 52/506

*Primary Examiner*—S. Kastler

*Attorney, Agent, or Firm*—Clifford A. Poff

[57] ABSTRACT

An enclosure or housing for a furnace structure or the like such as for a reheat furnace of the type used in steel rolling operations, the furnace enclosure being comprised of a self-supporting arch structure preferably of sheet material such as steel and having thermal insulation extending continuously over the inner or concave expanse thereof, the arch structure forming an elongated, arched furnace enclosure which provides improved thermal energy distribution, simplified design, and enhanced overall economy.

2 Claims, 2 Drawing Sheets

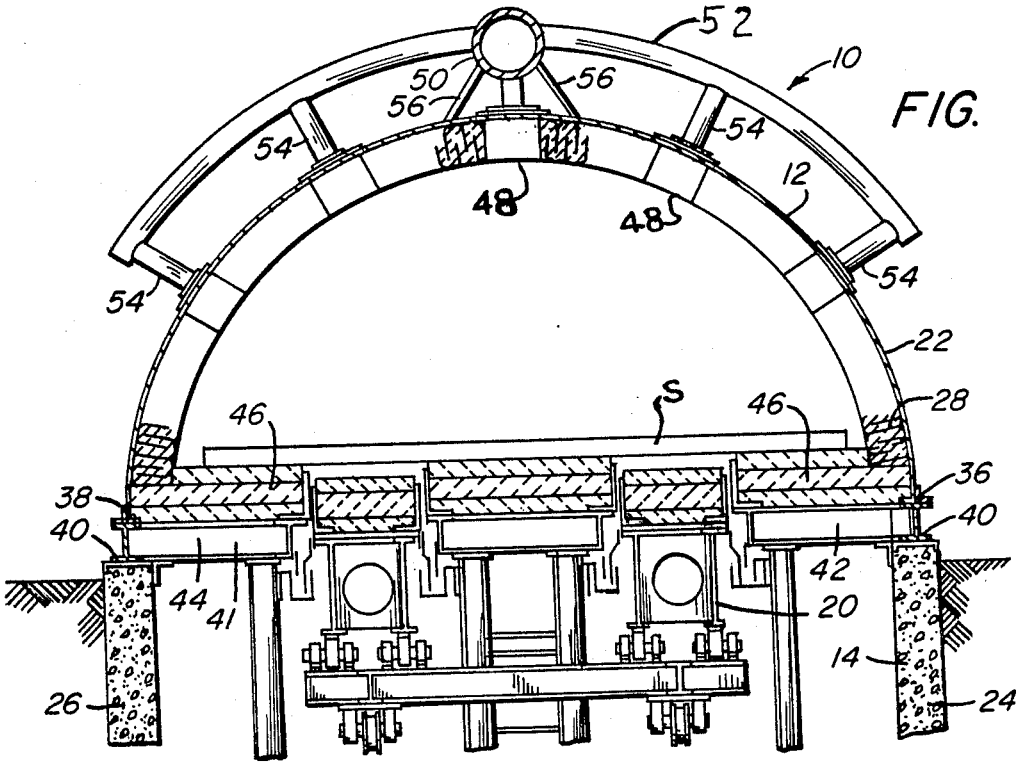
FIG. 3
FIG. 2
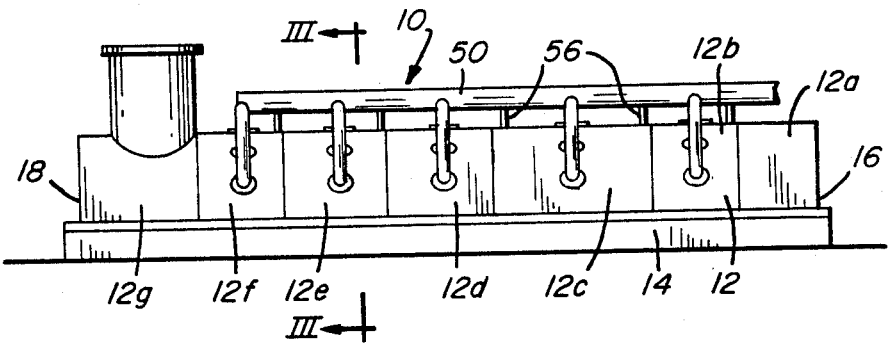
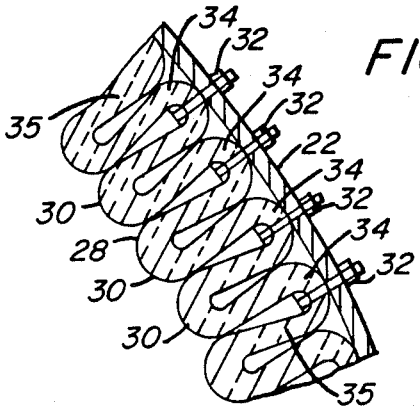
FIG. 4

FURNACE ENCLOSURE OR THE LIKE

BACKGROUND OF THE INVENTION

In the art of steelmaking it is well known to provide furnaces for the purpose of heating slabs or billets of steel during forming operations. For example, in steel rolling operation, the steel slabs being rolled must be maintained at a sufficiently elevated temperature to perform the rolling operations. Thus, as the steel slabs cool during extended rolling operations, they must be reheated at intervals to maintain the desired working temperature. To provide such reheating, reheat furnaces have commonly been provided in the form of an elongated furnace enclosure of refractory brick having vertical sidewalls and a slightly arched roof. Such furnaces also have a charging end and a discharge end, and a conveying means such as a walking beam structure which extends within the furnace intermediate the charge and discharge ends to move the workpieces in sequence through the furnace for reheating thereof.

Because such furnaces typically operate at very high temperatures, the enclosures therefor must provide a very high degree of thermal insulation in order to minimize heat loss to the ambient atmosphere. The efficiency of the thermal insulation in such furnace enclosures is, of course, directly related to the cost of reheating operations, and more specifically, to the fuel cost element.

Conventional furnace enclosures, for reheat furnaces such as above characterized and similar structures, typically have comprised a structure of refractory material such as refractory brick, as noted, which provides the requisite thermal insulation for the furnace enclosure. Such furnace structures also have been provided with further support structure such as an external framework of structural steel with hangers from which the refractory structure as well as pipes and headers of the fuel system are suspended. Such structural framework has been required due to the massive weight of refractory material that is required to provide to the requisite thermal insulation. In addition, the requisite network of fuel supply pipes and headers must be supported. For these and other reason, conventional furnace construction has dictated furnace structures as above characterized. Due to energy cost escalation and competitive pressure from lower cost steel making operations, practitioners in the steel making arts have continually sought capital cost improvements for various aspects of steel making operations, including those pertaining to reheat furnace structures and the like.

BRIEF SUMMARY OF THE INVENTION

The present invention contemplates a novel and improved furnace enclosure for use in reheat furnace structures and the like, and comprises in one presently preferred embodiment a plurality of modular furnace enclosure structures, each including a formed, self-supporting arch of sheet steel for example, and a blanket of lightweight but highly efficient thermal insulating material affixed to and extending throughout the expanse of the inner or concave side of the self-supporting arch. The thermal insulating material is formed in deep folds or corrigations and is secured to the concave side of the arch by fasteners which are passed therethrough and secured to the arch.

The improved furnace enclosure provides a simplified yet remarkably sturdy structural base for supporting the required network of fuel supply pipes and headers that direct fuel to the furnace burners. The burners are installed in and penetrate the concave enclosure to provide thermal energy to the interior of the furnace for reheating operations.

The invention also contemplates enhanced properties of thermal energy distribution within the novel furnace enclosure owing to the arched structured thereof. In conventional furnaces the vertical sidewalls and slightly arched roof have presented an interior surface configuration which tends to concentrate thermal energy at laterally outer edges of elongated slabs or other workpieces passing through the furnace. In addition, the outermost edges of such workpieces tend to absorb thermal energy at a proportionally greater rate than other zones of the workpiece because the areas adjacent the outer edges are surrounded on three sides by exterior surfaces, i.e. the top, bottom and edge of the workpiece. By contrast, zones of the workpiece located further inward from the edges are subjected to lesser concentrations of thermal energy in conventional furnaces, and have a distinctly different surface area geometry through which the thermal energy may be absorbed. The result has been, in conventional furnaces, excess heating of lateral edge portions of the workpieces to the detriment of the reheat process.

The arched configuration of my novel furnace enclosure provides for improved patterns of thermal energy distribution, primarily owing to improved surfaceto-surface thermal energy radiation within the furnace enclosure. The invention thus provides greatly reduced structural strength requirements for a furnace enclosure, and improved thermal energy retention and distribution charcteristics over those of conventional furnaces. The novel furnace enclosure also provides the benefits of low initial capital cost, low structural weight, and a modular design which provides ease of fabrication, transport, assembly and maintenance. Also according to this invention, a combined roof and sidewall structure embodied in the arch configuration provides a completely self-supporting furnace enclosure which obviates the conventional need for a structural framework from which to suspend portions of the enclosure.

It is therefore one object of the present invention to provide a novel and improved furnace enclosure.

A more specific object of the invention is to provide a furnace enclosure structure which is formed as a self-supporting arch structure having roof and sidewall portions which extend circumferentially with respect to a center point.

A still more specific object of the invention is to provide a furnace enclosure comprised of enclosure modules formed as supporting structural arches of sheet material such as steel, each having thermal insulating material affixed to and extending throughout the inner or concave expanse thereof.

A further object of the invention is to provide a furnace enclosure which provides improved thermal energy retention and distribution.

These and other objects and further advantages of the invention will be more fully appreciated upon consideration of the following detailed description and the accompanying drawings in which:

FIG. 2 is a generally schematic side elevation of a reheat furnace constructed according to principles of the present invention;

FIG. 3 is a sectional view taken on line III—III of FIG. 2; and

FIG. 4 is an enlarged fragmentary portion of the furnace enclosure of FIG. 3.

Figure 1:
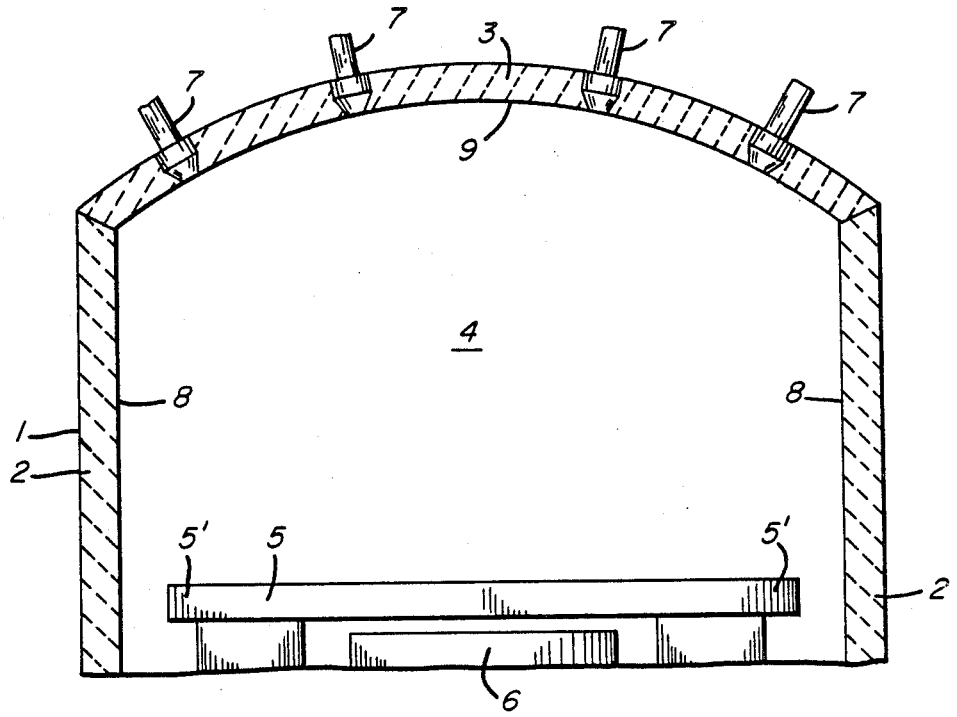
FIG. 1 (PRIOR ART)
FIG. 1 is a generally schematic cross section of a conventional furnace enclosure.

There is shown in FIG. 1 a cross section view, generally simplified and schematic in form, of a conventional reheat furnace 1 having vertically upstanding side walls 2 and an arched roof 3 which bridges the side walls to form an elongated enclosed space 4 through which workpieces such as steel slabs or billets 5 are moved as by a walking beam apparatus 6 for reheating of slabs 5. To supply heat for such reheating, a plurality of burners 7 penetrate roof 3 to provide an air and hydrocarbon fuel mix for combustion within space 4. The air and fuel mix is provided to burners 7 via any suitable and conventional header and manifold system (not shown in FIG. 1).

In a conventional furnace such as shown in FIG. 1, the interior surfaces of enclosure 1 are comprised of vertically extending inner surfaces 8 of sidewalls 2, and a generally downwardly facing inner surface 9 of roof 3. In practice, the vertical orientation of surfaces 8 with respect to edge portions 5' of slabs 5, in conjunction with the concavity of roof surface 9, tends to concentrate thermal energy in the area of the edge zones 5'. This undesirable concentration of thermal energy, and the known edge effects (that is, the increased energy absorption in zones 5' due to exposure of the slab edges to the heat) result in undesirable nonuniform heating of the slab as it progresses through the furnace.

To address the above described and other shortcomings of conventional furnaces, applicant has invented a novel furnace enclosure structure as shown in FIGS. 2 and 3 wherein there is generally indicated at 10 a furnace, for example a reheat furnace such as used in steel slab rolling operations, and comprising an elongated housing or enclosure 12 supported on opposed side walls 24, 26 of a foundation 14 and including a charging end 16, and a discharge end 18, each of which is provided with a suitable opening to accommodate movement therethrough of steel slabs S as upon conventional walking beam apparatus 20 for reheating of the steel slabs S during rolling operations. According to the present invention, the furnace enclosure 12 preferably is comprised at least in part of a plurality of identical modular structural arches or shell segments 12*a*, 12*b*, 12*c*, 12*d*, 12*e*, and 12*f*.

The term structural arches or other references herein to the arched configuration of my novel furnace enclosure is intended to refer to a continuously curved arch, although not necessarily, one having a uniform radius of curvature. My references herein to the arched configuration of my novel furnace enclosure, both in the description and in the claims, is not intended to be construed in any sense to broadly cover both the arched structure of my novel furnace enclosure and that of prior art furnace enclosures such as that depicted in FIG. 1.

Other portions of the furnace enclosure 12 may likewise be formed by similar although not necessarily identical structural arches such as shown at 12*g*. Each structural arch, for example the module 12*d* and others as shown in FIG. 2, is comprised of an expanse of self-supporting sheet-form material, sheet steel for example, which is formed in a continuously curved arched configuration to provide a containment 22 which exends up and over the space intermediate the opposed foundation walls 24 and 26, to thereby bridge the same and form the arched furnace enclosure between opposed foundation walls 24 and 26. The length of each enclosure module 12*a*, et al. may be approximately eight to ten feet, for example. The respective modules as described are secured together end-to-end by any suitable fasteners to form the elongated furnace enclosure 12.

Each module 12*a*, et al. also comprises a blanket of thermal insulating material 28 affixed adjacent the inner or concave surface of wall 22 and extending substantially continuously throughout the inner concave expanse thereof to provide the requisite thermal insulation for the furnace 10. The thermal insulating material 28 may be, for example, a blanket of KAOWOOL$^{tm}$ Brand ceramic fiber insulating material. The blanket of insulating material 28 preferably is arranged in deep corrigations or accordian folds 30 (FIG. 4) and supported with respect to the containment wall 22 by being suspended therefrom, as by a plurality of any suitable fasteners 32 which are passed through the insulating material 28 in the folded portions 34 thereof adjacent to the containment wall 22. The insulation blanket 28 thus is secured with respect to the wall 22 adjacent the inner or concave surface thereof such that flank portions 35 of each fold 30 extend generally radially of the arched containment wall 22.

The folds 30 preferably are to be formed as densely and tightly as is practicable in order to provide the requisite thermal insulation properties. That is, gaps between adjacent folds 30 are preferably to be minimized. The folds 30 are shown more open in FIG. 4 merely for purposes of illustrative clarity.

To secure the insulation blanket 28, any suitable fasteners may be employed, including but not limited to self tapping screws, nut and bolt assemblies, rivets, and the like. The material from which the fasteners are fabricated must be compatible with the materials used for containment wall 22 and insulation 28, as well as with the high temperature environment of the furnace. Suitable washers or the like may also be provided as needed to ensure a sufficient mechanical grip of the fasteners 32 on the insulation blanket 28 to support the same with the requisite structural integrity.

The combined insulation blanket 28 formed as specified, and the arched containment wall structure 22, together provide a self-supporting furnace enclosure module of very lost cost and light weight with all the requisite structural strength and thermal insulating capabilities required for utilization thereof in constructing a high temperature reheat furnace. Specifically, and as shown in FIG. 3, the individual arch modules such as module 12*d* have opposed lower edge portions 36 and 38 which are supported upon a sill 40 formed, for example, as a portion of a structural steel base 41 and supported at least on the respective opposed foundation walls 24 and 26. The base 41 may also contemplate conventional stationary support portions 42, 44 which cooperate with walking beam apparatus 20 in a well known manner for translation of the slabs S through the furnace 10. The support portions 42 and 44 thus may be provided with conventional insulating material such as refractory 46 which is also cooperable with the lower edge portions 36 and 38 of each enclosure module to form a thermal barrier adjacent to the edges 36 and 38 where the respective modules are supported on sill 40.

Of course, various other conventional structural features of reheat furnaces also are included in, and to the extent necessary cooperate with, the novel furnace enclosure of this invention. For example, burners 48 may penetrate selected arch modules at various locations to provide the thermal energy input necessary to maintain the temperature within the furnace for reheating of slabs S being passed therethrough. As shown in FIGS. 2 and 3, my novel furnace enclosure supports a suitable network of interconnected headers 50 and manifolds 52 which direct a combustible fuel mixture via burner inlet conduits 54 to the burners 48. Suitable supports such as partially shown at 56 are provided to support the fuel supply system with respect to the novel containment wall system whereby the need for additional structural supports for suspended support of headers, manifolds, and the furnace enclosure itself, is avoided. The arched furnace enclosure structure thus provides a furnace enclosure having a self-supporting clear span side wall and roof configuration formed as a continuous arch of extremely simple and efficient design and made up in modules which may be assembled on-site to permit quick and efficient fabrication of the furnace enclosure.

Another distinct advantage of the disclosed furnace enclosure is that the overall arched geometry provides certain thermal benefits, as above noted, which overcome the thermal energy distribution shortcomings of conventional furnace enclosures. Specifically, the disclosed arch configuration for the sidewall and roof system of my novel furnace enclosure reduces wall area in the region adjacent to the ends of billets or bars which may be passed through the furnace oriented with the length thereof extending laterally of the path of travel through the furnace. An entirely similar benefit arises with regard to the laterally opposed edge portions of an elongated slab oriented with its longitudinal extent coinciding with the path of travel through the furnace. As has been mentioned, known edge effects can tend to cause overheating of these laterally spaced portions of a workpiece. The interior geometry of prior furnaces tends to concentrate internally reflected thermal energy in the areas occupied by such laterally opposed portions of the workpiece thereby aggravating undesired overheating.

By contrast, the continuous arch geometry of my novel furnace enclosure provides a distinctly beneficial pattern of internal thermal energy reflection through improved surface-to-surface thermal radiation circumferentially of the arched structure. Because thermal energy is very long-wave radiation, discontinuities in the arched structure such as the exposed folds of the insulating blanket have no significant impact on the overall pattern of internal thermal energy reflection. Accordingly, thermal energy is reflected internally as though it were impinging on a smooth, arched reflective surface of uniform circumference. The result is avoidance of undesirable concentrations of internally reflected radiant energy in edge regions of the workpieces being processed through the furnace.

According to the description hereinabove, there is provided by the instant invention a novel and improved furnace enclosure offering numerous benefits including many related to reduction of capital cost, reduction of operating cost, ease of fabrication, construction and maintenance, improved thermal characteristics, and the like. Of course, I have envisioned various alternative and modified embodiments of the invention, and such certainly would also occur to others versed in the art, once apprised of my invention. Accordingly, it is my intent that the invention be construed broadly and limited only by the scope of the claims appended hereto.

I claim:

1. A high temperature furnace for heating metallic workpieces, said furnace comprising:

a plurality of arch shaped shell segments adapted to be joined end-to-end in aligned relationship to form a furnace roof and side walls all comprised of the arch shaped configuration of the segments, said shell segments having opposed lower edge portions, a foundation including spaced apart sills on which said opposing lower edge portions are supported for forming a self-supporting arch configuration, blankets of thermal insulating material formed in deep folds with flank portions of said folds extending radially with respect to the arch configuration of said arch shaped shell segments, means passed through portions of said thermal insulating material adjacent to said shell segments and affixed thereto to suspend and support said blankets from the segments, burners supported by at least some of said shell segments for introducing hot gases into the interior of the arch shaped configuration of the shell segments for heating workpieces therein, and means for supporting and advancing workpieces in a direction transverse to the arch shaped configuration of the shell segments.

2. The apparatus according to claim 1 wherein said arch shaped shell segments are continuously laterally curved at a uniform radius of curvature.

* * * * *